US007179118B1

(12) United States Patent
Harlan et al.

(10) Patent No.: US 7,179,118 B1
(45) Date of Patent: Feb. 20, 2007

(54) CONNECTOR FOR FLEXIBLE PRINTED CIRCUIT

(75) Inventors: Tod M. Harlan, Mechanicsburg, PA (US); Terrance F. Little, York, PA (US); Kevin E. Walker, Hershey, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/377,876

(22) Filed: Mar. 15, 2006

(51) Int. Cl.
*H01R 12/24* (2006.01)

(52) U.S. Cl. ..... 439/495; 439/260

(58) Field of Classification Search ..... 439/260, 439/495

See application file for complete search history.

(56) References Cited

U.S. PATENT DOCUMENTS 5,924,891 A * 7/1999 Benjamin et al. ..... 439/495
6,089,905 A * 7/2000 Shimmyo et al. ..... 439/495
6,669,503 B2 * 12/2003 Hirose ..... 439/495
7,029,319 B2 * 4/2006 Kunishi ..... 439/492
7,044,773 B2 * 5/2006 Suzuki et al. ..... 439/495
7,048,573 B2 * 5/2006 Masaki et al. ..... 439/492

* cited by examiner

*Primary Examiner*—Thanh-Tam Le
(74) *Attorney, Agent, or Firm*—Wei Te Chung

(57) ABSTRACT

An electrical connector (1) for receiving an apertured flat connection member (6) includes: an insulative housing (10) providing an opening (11) for receiving a flat connection member (6) and defining a forward direction along which an inserted flat connection member is pulled out of the opening; a number of conductive contacts (20) having contact portions extending into the opening; an actuator (30) pivotally urging the contacts to connect with the flat connection member; a locking lug (32) extending from the actuator for engaging an aperture (62) of the flat connection member, and a pad (33) formed beside the locking lug for pressing a portion of the flat connection member against the housing.

18 Claims, 8 Drawing Sheets

CONNECTOR FOR FLEXIBLE PRINTED CIRCUIT

BACKGROUND OF THE INVENTION

1. Field of the Invention

The present invention relates to an electrical connector, and more particularly to an electrical connector for a flat connection member such as a flexible printed circuit or cable (FPC), a flexible flat cable (FFC) and so forth. All of these cables and circuit hereafter will be generally referred to as "FPC" for simplification.

2. Description of Related Art

Electrical connectors for connecting an FPC basically comprise an insulator defining an FPC receiving cavity, a plurality of conductive contacts arranged in the insulator and having contact portions exposed in the FPC receiving cavity, and an actuator rotatably mounted with respect to the insulator and the contacts. The FPC is inserted into the receiving cavity with Zero Insertion Force to a predetermined position and then is urged to establish electrical connection with the contact portions by the rotated actuator. To retain the FPC in the receiving cavity and maintain the electrical connection between the FPC and the contacts, an FPC retention force is required. The FPC retention often is provided by friction between the FPC and the contacts pinching the FPC or the actuator pressing on exterior surface of the FPC. However, this friction is often deficient in supplying a retention force enough for resisting unintentional pull, especially in connectors wherein the retention force is only supplied by the friction between the FPC and the contacts pinching it. An electrical connector of this type can be seen in U.S. patent application Publication No. 20040023551 (Suzuki et al.) which comprises a plurality of conductive contacts each having two opposing contact beams, namely an upper and a lower contact beams, defining an FPC receiving space therebetween. After the FPC is inserted into the receiving space, an actuator is operated to urge the opposing contact beams to pinch the FPC thereby to establish electrical connection between the contacts and the FPC. Inherent with such design, the actuator cannot press on the exterior surface of the FPC. Thus, the FPC retention is merely capable from the pinching effects of the contact beams. Thus a need exists to develop more retention force than is capable from the pinching effects of the contacts alone.

There is an electrical connector of above-mentioned type intending to obtain more FPC retention. The connector further comprises a locking system including a pair of locking pins protruding from two longitudinal outermost portions of the actuator (at positions to avoid the upper contact beams) and a pair of locking holes defined in the FPC at corresponding positions. When the actuator is rotated to a horizontal position, the locking pins engage with the locking holes, thereby supplying additional retention mechanism. However, as the FPC is rather thin, when the locking pin engages with the edge of the locking hole, the FPC portion in back side of the hole (to the rear of the hole edge) without support from its upper surface will flex and move out of the way because it is not rigid enough. There is an effort to design the plastic actuator with features functioning as the metallic locking pins. However, a forced withdrawal of the FPC is still apt due to shearing action of the FPC upon the plastic features.

Therefore, a new FPC connector is desired to overcome the disadvantages of the prior arts.

SUMMARY OF THE INVENTION

An object of the present invention is to provide an FPC connector having elevated FPC cable retention qualities.

In order to achieve above-mentioned objects, an FPC connector for connecting an FPC in accordance with a preferred embodiment of the present invention includes An electrical connector for receiving an apertured flat connection member, comprising: an insulative housing providing an opening for receiving a flat connection member and defining a forward direction along which an inserted flat connection member is pulled out of the opening; a plurality of conductive contacts having contact portions extending into the opening; an actuator pivotally urging the contacts to connect with the flat connection member; a locking lug extending from the actuator for engaging an aperture of the flat connection member; and a pad situated rearwardly of the locking lug for pressing on a portion of the flat connection member.

Other objects, advantages and novel features of the present invention will become more apparent from the following detailed description of the present embodiment when taken in conjunction with the accompanying drawings.

DETAILED DESCRIPTION OF THE INVENTION

Figure 1:
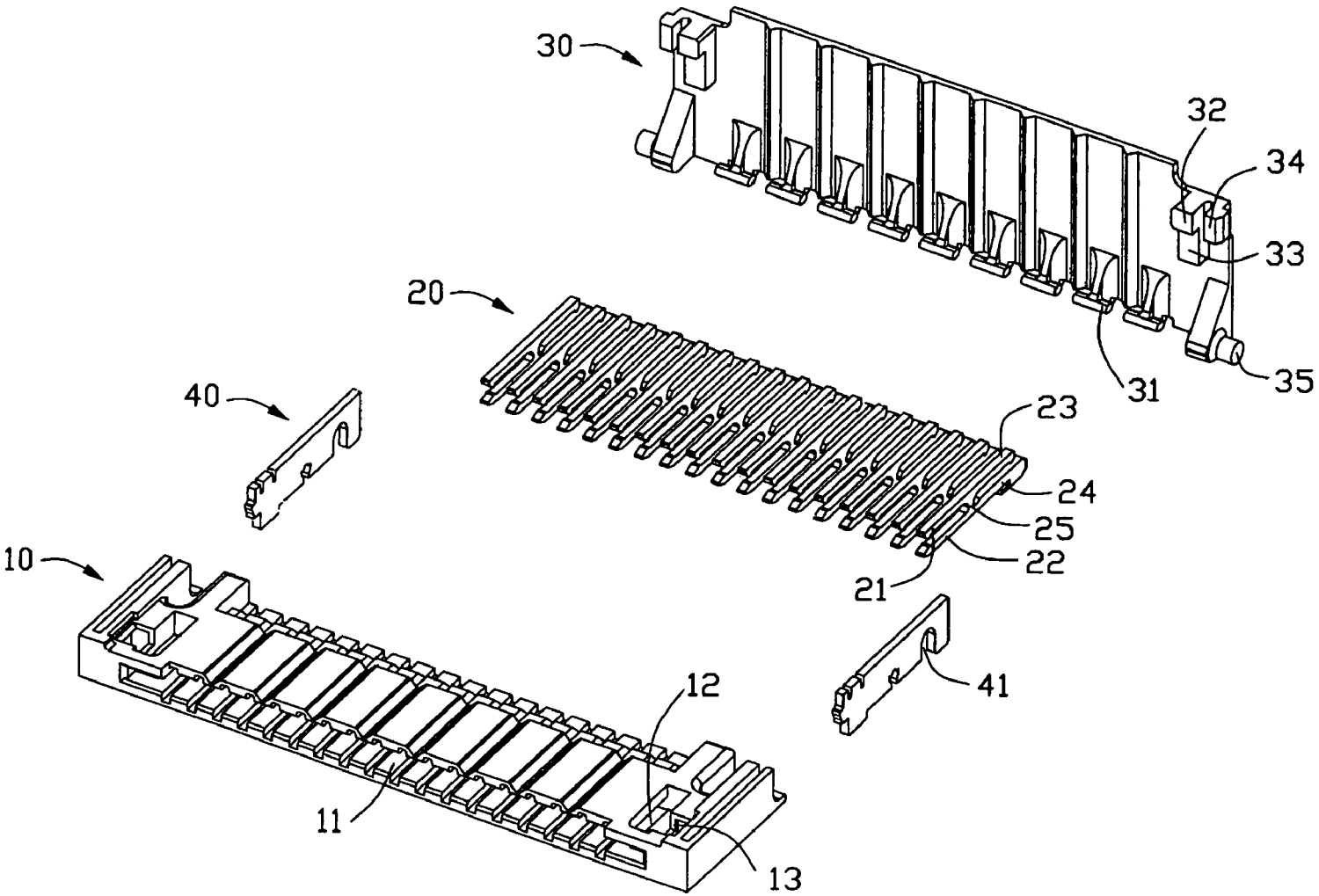
FIG. 1 is an exploded perspective view of an FPC connector in accordance with the preferred embodiment of the present invention.

Reference will now be made to the drawing figures to describe the preferred embodiment of the present invention in detail.

Figure 2:
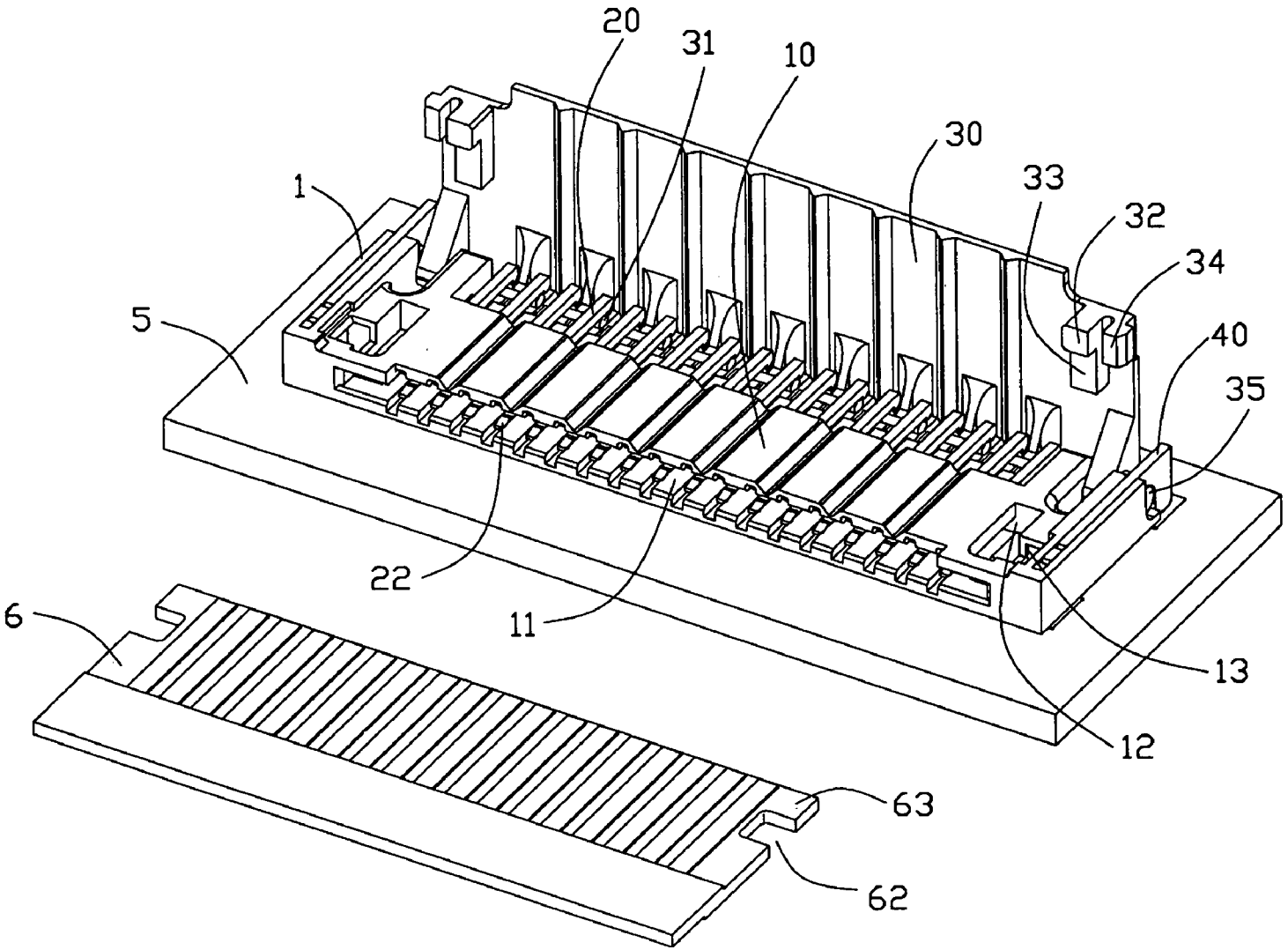
FIG. 2 is an assembled perspective view of the FPC connector with an actuator thereof in an open position and an FPC disposed in front of it.
Figure 3:
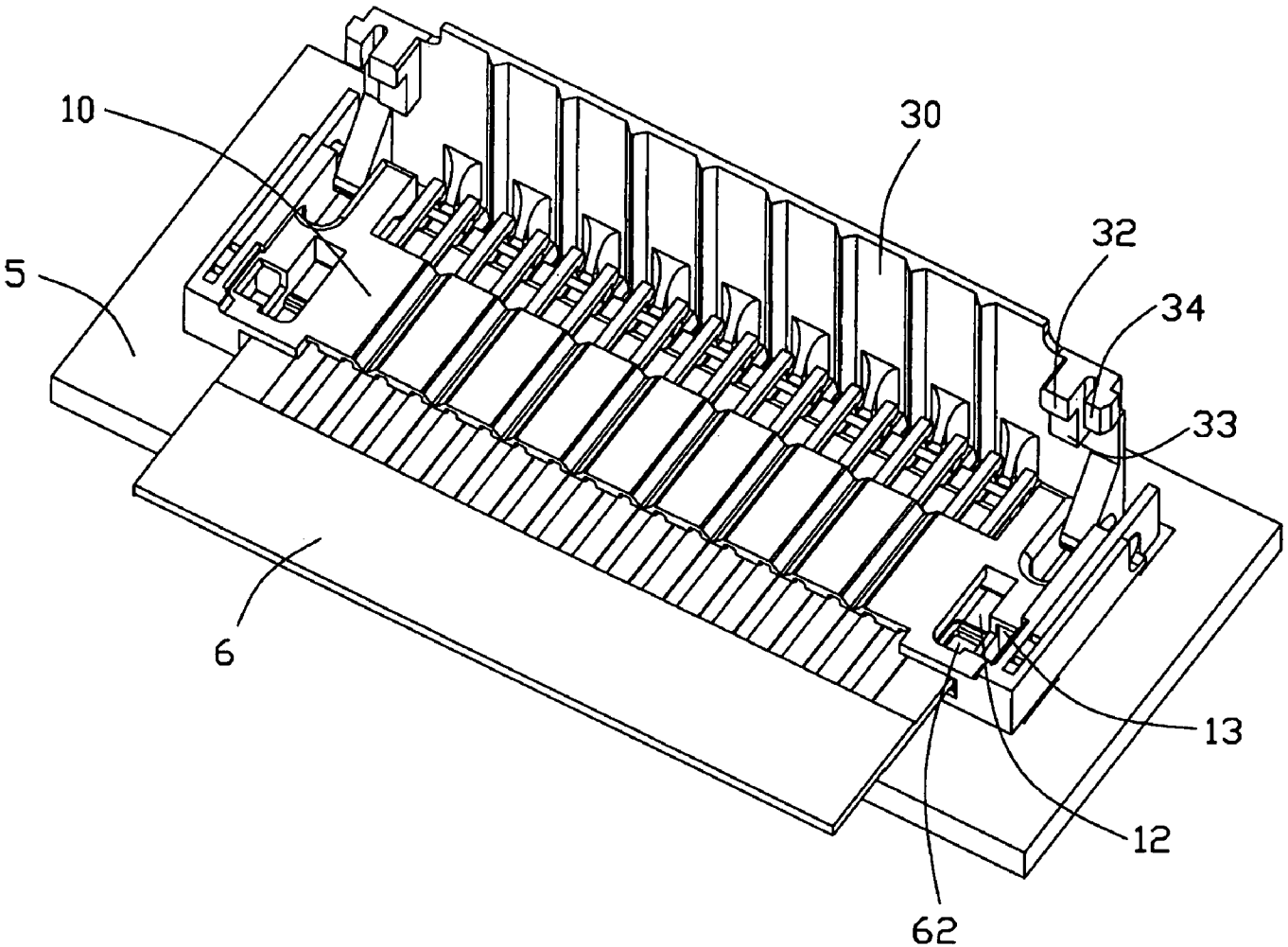
FIG. 3 is a view similar to FIG. 2, but the FPC has been inserted into the connector.
Figure 4:
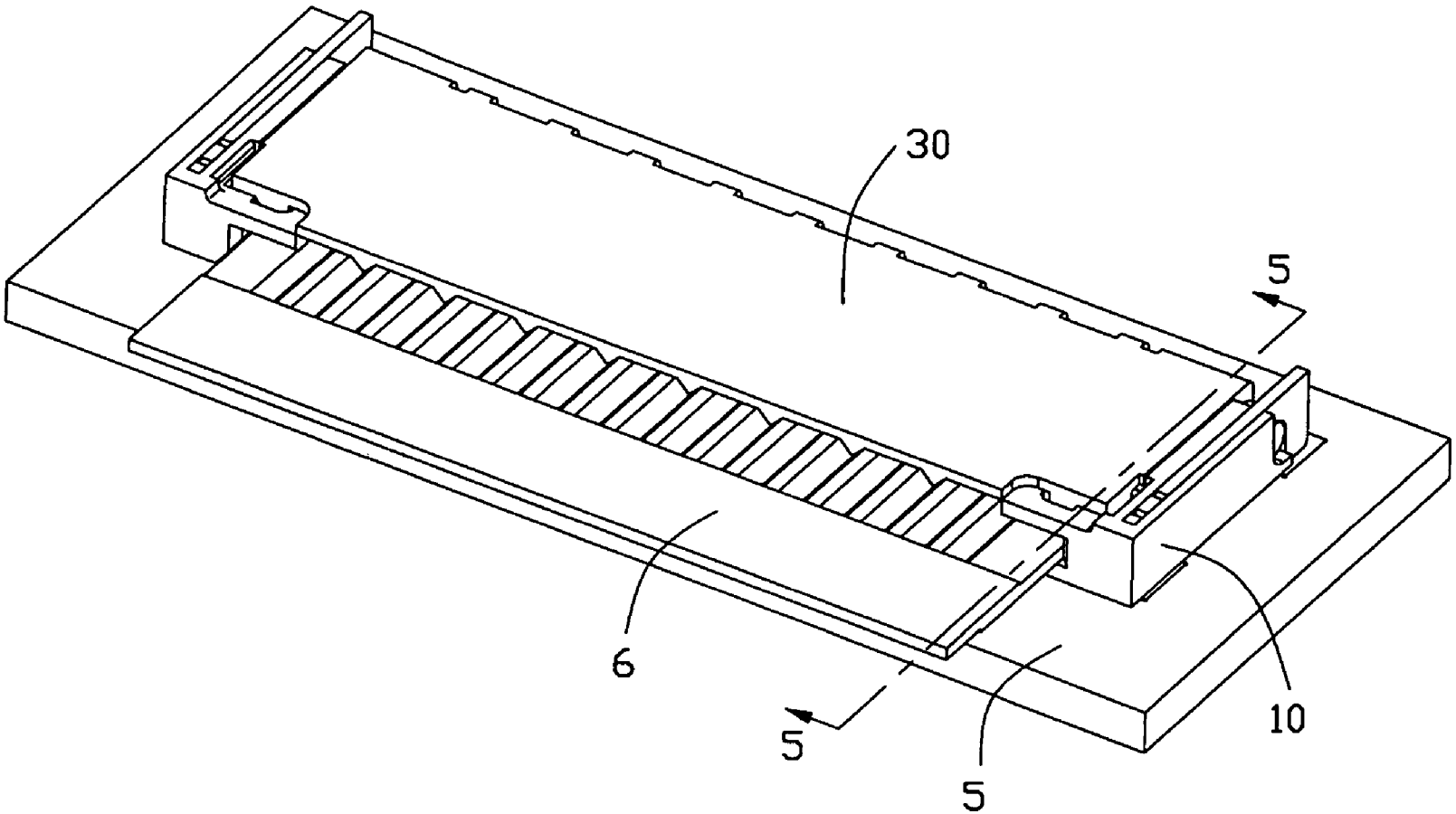
FIG. 4 is a view showing the connector with the actuator in a closed position.

Referring to FIGS. 1–3, an FPC connector 1 for connecting an FPC 6 to a board 5 or the like in accordance with a preferred embodiment of the present invention comprises an insulative housing 10 defining an FPC receiving cavity 11, a plurality of H-shaped conductive contacts 20 each comprising a joint 25, opposing upper and lower contact beams 21, 22 extending forwards from the joint 25 and opposing pivot beam 23 and solder beam 24 extending rearwards from the joint 25, an actuator 30 pivotally supported to the contacts 20, and a pair of end clips 40 assembled to longitudinal outermost side portions of the housing 10 for retaining the actuator 30. The actuator 30 has a plurality of separated shaft portions 31 and a pair of end posts 35. In assembly, the shaft portions 31 are respectively disposed between the pivot beam 23 and the solder beam 24 of the contacts 20 and the end posts 35 are respectively received in a hole 41 in the end clip 40 and thereby rotatablely restricted between the end clip 40 and the housing 10. The shaft portion 31 is of an oval-shaped section so that when the actuator 30 is in an open position the opposing upper and lower contact beams 21, 22 are open for receiving the FPC 6, and when the actuator 30 is in a closed position the opposing upper and lower contact beams 21, 22 are urged close to pinch the FPC 6 therebetween and thereby contact portions formed by the upper contact beams 21 are driven to contact conductors (not labeled) on the FPC 6.

Figure 5:
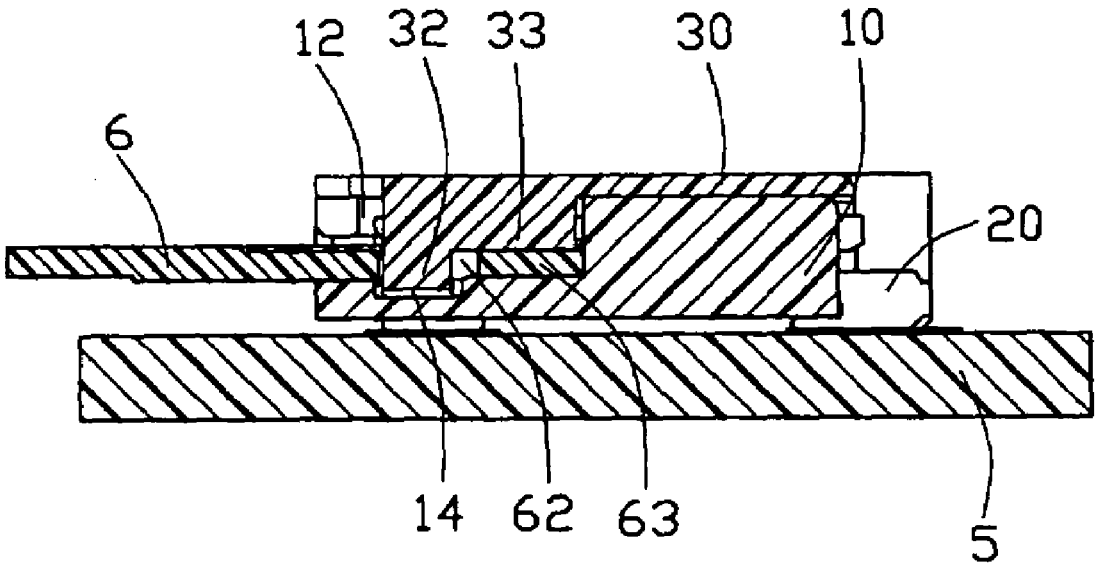
FIG. 5 is a cross-sectional view of FIG. 4 taken along line 5—5 showing engagement between the actuator and the FPC.

Referring to FIGS. 2–5, for attaining a high FPC retention force, there is a locking system between the actuator 30 and the FPC 6. The locking system comprises a pair of locking lugs 32 protruding from two longitudinal end portions of the actuator 30 (at positions to avoid the upper contact beams) and a pair of locking apertures defined as open notches 62 communicating with border of the lateral edge of the FPC in this preferred embodiment. There is a pad 33 behind the locking lug 32. Correspondingly, the housing 10 defines a through slot 12 in an upper wall thereof for the locking lug 32 and the pad 33 to pass through and a recess 14 in a lower wall or bottom base thereof for receiving a distal end of the locking lug 32. After the FPC 6 is inserted in the receiving cavity 11 and has the notches 62 thereof aligned with the through slot 12 and recess 14 of the housing 10, the actuator 30 is rotated to the closed position to urge the contact beams 21, 22 to pinch the PFC 6 and establish electrical connection between the contacts 20 and the FPC 6. During rotating of the actuator 30, the locking lug 32 passes through the slot 12 and the notch 62 and protrudes into the recess 14, and the pad 33 passes through the slot 12 and presses on the upper surface of a rear flap 63 of the PFC 6 located behind the notch 62 against the bottom base of the housing 10, as best shown in FIG. 5. The actuator 30 further has a pair of latches 34 each being pressed into a slot 13 which communicates with the through slot 12 so as to retain the actuator 30 in the closed position.

With such a structure, the overall retention force is the normal force from the pinching effects of the contact beams 21, 22, added with a retention force from engagement of the locking lugs 32 and the locking notches 62, plus the rear flap 63 of the PFC 6 being supported from the upper and bottom surfaces thereof, and therefore is high enough for preventing the FPC 6 from being pulled out of the connector 1. Moreover, as being supported from the upper and bottom surfaces, the thin/flimsy rear flap 63 is enabled to be rigid and thereby avoid flexing or moving out of the way. This arrangement elevates the strength of the lug 32 as the FPC cable is pulled against it.

Figure 6:
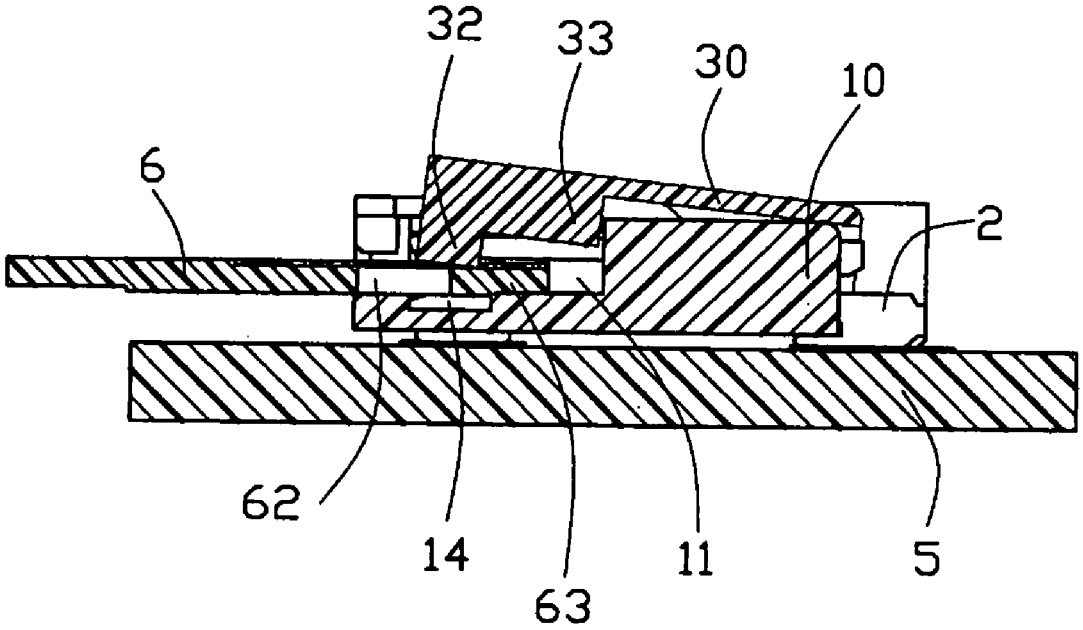
FIG. 6 is a cross-sectional view similar to FIG. 5 showing an instance the FPC is not completely inserted into the connector.

Further, referring to FIG. 6, an additional benefit is that if the FPC 6 is not fully inserted to the receiving cavity 11 and properly positioned, before the actuator 30 is closed, the post 32 will act as a "proper position detector". This is so because the post 32, being longer so as to enter the recess 14, will be resting at a larger angle compared to that assumed by a shorter post, e.g. approximately a 15 to 20 degrees angle with respect to a horizontal line. This will serve as a visual aid to an operator, that the FPC is not inserted to the proper depth.

Figure 7:
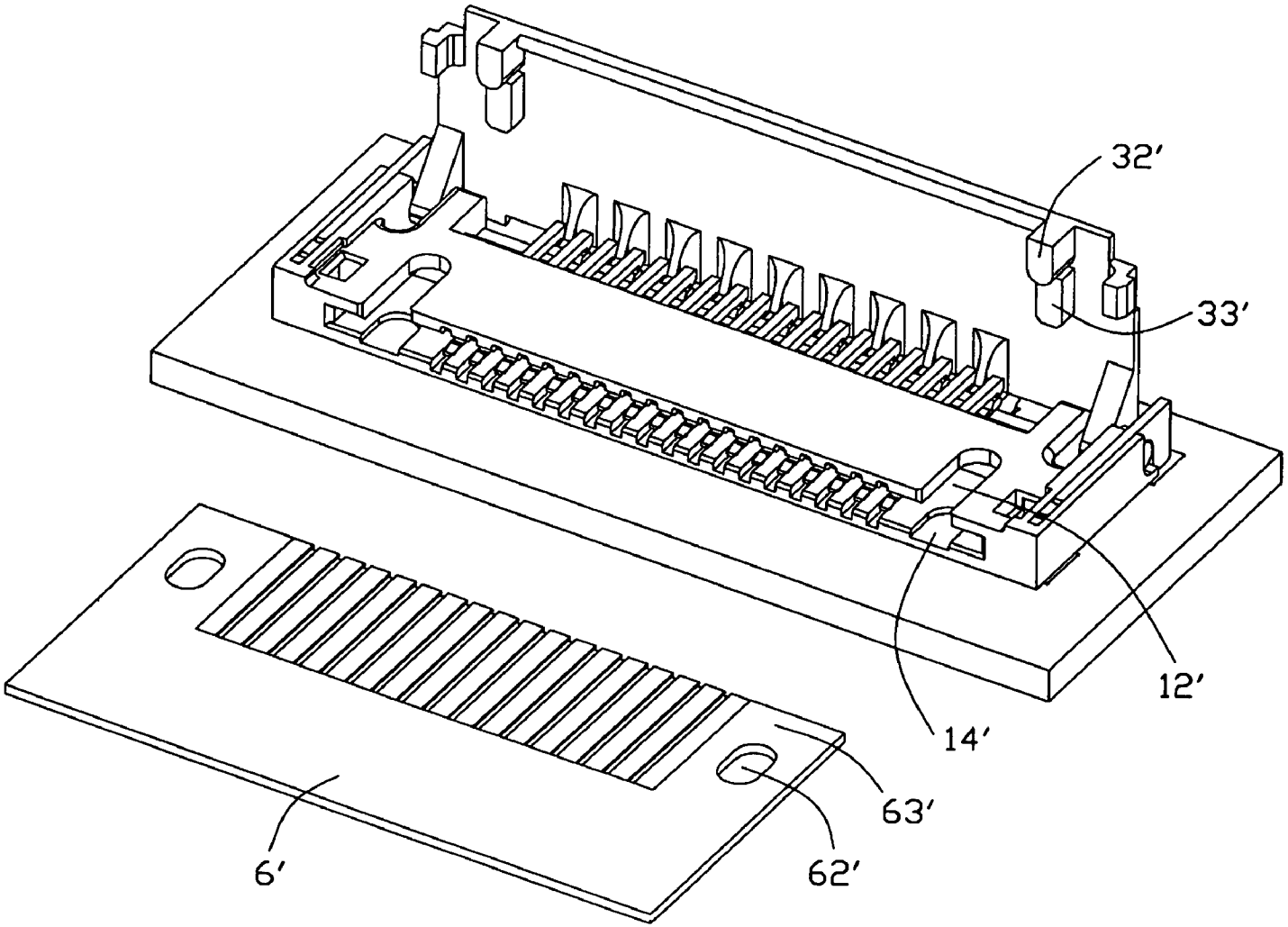
FIG. 7 is a view showing a locking aperture in a second form different from that of FIG. 2.
Figure 8:
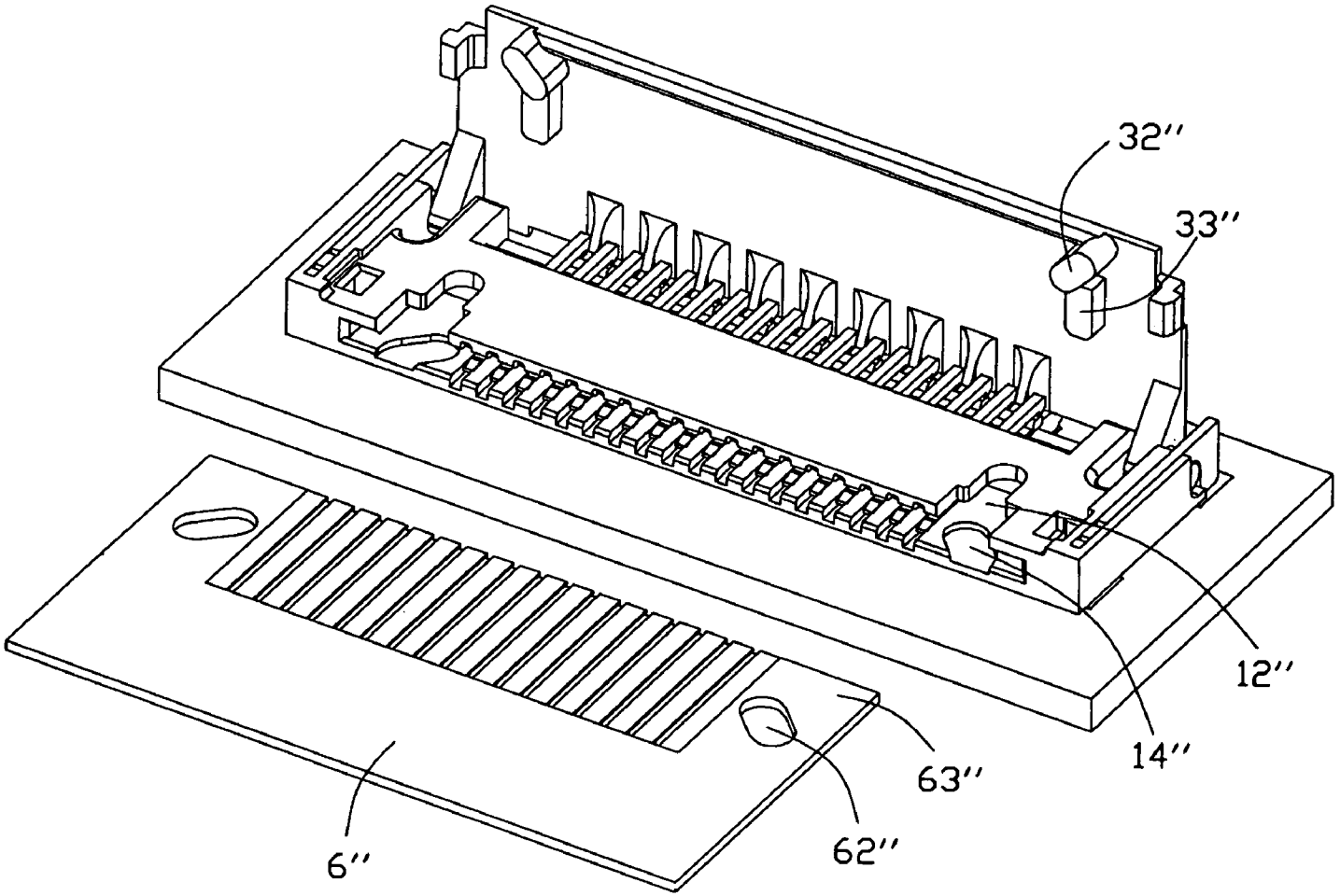
FIG. 8 is a view showing the locking aperture in a third form.

The above disclosure is illustrative only and changes may be made in detail, especially in matter of shape, size, and arrangement of parts within the principles of the invention. For example, the locking aperture can be in the form of through hole. The hole can be a circular hole or an oblong hole. Moreover, in the case of an oblong hole, it can be a straight one 62' as illustrated in FIG. 7 or an angled one 62" which is oriented approximately a 45 degree angle relative to the insertion direction of FPC as illustrated in FIG. 8. In addition, the locking lug and the slot defined through the upper wall of the housing and the recess defined in the lower wall of the housing will be shaped according to the shape of the aperture.

What is claimed is:

1. An electrical connector for receiving an apertured flat connection member, comprising:

an insulative housing providing an opening for receiving a flat connection member and defining a forward direction along which the inserted flat connection member is pulled out of the opening;

a plurality of conductive contacts having contact portions extending into the opening;

an actuator pivotally urging the contacts to connect with the flat connection member;

a locking lug extending from the actuator for engaging an aperture of the flat connection member; and a pad situated rearwardly of the locking lug for cooperating with the housing to support a portion of the flat connection member located rearwards from the aperture;

wherein the housing includes opposite upper and base walls commonly defining said opening, the upper wall is located right above the contacts, and said actuator is seated upon said upper wall when said actuator is located in a locked position.

2. The electrical connector as described in claim 1, wherein the housing defines a through slot for the locking lug and the pad to pass through.

3. The electrical connector as described in claim 1, wherein the housing defines a recess for receiving a distal end of the locking lug.

4. The electrical connector as described in claim 1, wherein the contacts are arranged along a longitudinal direction of the housing perpendicular to the forward direction, and wherein, when the actuator is closed to urge the contacts to connect with the flat connection member, the locking lug is positioned longitudinally beside the contacts.

5. An electrical connector for receiving an apertured flat connection member, comprising:

an insulative housing providing an opening for receiving a flat connection member and having a bottom base, the bottom base having a recess;

a plurality of conductive contacts having contact portions extending into the opening;

an actuator pivotally urging the contacts to connect with the flat connection member; and a locking lug extending from the actuator, through an aperture of the flat connection member, to enter the recess;

wherein the housing defines a through slot aligning with the recess along a vertical direction for the locking lug to pass through.

6. The electrical connector as described in claim 5, wherein the housing defines a forward direction along which the inserted flat connection member is pulled out of the opening, and the actuator comprises a pad formed by the locking lug for supporting on a portion of the flat connection member located rearwards from the aperture.

7. The electrical connector as described in claim 5, wherein the housing includes an upper wall opposite to and cooperating with the bottom base to define said opening, the upper wall is located right above the contacts, and said actuator is seated upon said upper wall when said actuator is located in a locked position, wherein said slot is defined in said upper wall.

8. An electrical connector comprising:

an insulative housing providing an opening for receiving a flat connection member and defining a forward direction along which the flat connection member is pulled out of the opening;

a plurality of conductive contacts secured to the housing and having contact portions extending into the opening;

a flat connection member having an aperture and a rear flat portion rearwardly of the aperture;

an actuator pivotal to urge the contacts to connect with the flat connection member and to press the rear flat portion against the housing; and a locking lug extending from the actuator for engaging the aperture of the flat connection member;

wherein the housing includes opposite upper and base walls commonly defining said opening, the upper wall is located right above the contacts, and said actuator is seated upon said upper wall when said actuator is located in a locked position.

9. The electrical connector as described in claim 8, wherein the flat connection member is formed with a row of conductors arranged along a longitudinal direction perpendicular to the forward direction, and the aperture is longitudinally aligned on an outer side of the row of conductors.

10. The electrical connector as described in claim 8, wherein the actuator is provided with a pad contacting an upper surface of the rear flap portion, and the housing contacts a lower surface of the rear flap portion.

11. The electrical connector as described in claim 10, wherein the locking lug extends longer than the pad in a vertical direction.

12. The electrical connector as described in claim 8, wherein the actuator makes physical contact with the flat connection member only on the rear flat portion.

13. The electrical connector as described in claim 8, wherein the housing defines a recess for receiving a distal end of the locking lug extending below the flat connection member through the aperture.

14. The electrical connector as described in claim 8, wherein each of the contacts comprises opposing upper and lower beams, the upper constituting the contact portion.

15. The electrical connector as described in claim 8, wherein the aperture is a closed through hole.

16. The electrical connector as described in claim 15, wherein the through hole is oblong and has a major axis oriented along an inserting/pulling direction of the flat connection member.

17. The electrical connector as described in claim 15, wherein the through hole is oblong and had a major axis oriented at an angle relative to an inserting/pulling direction of the flat connection member.

18. The electrical connector as described in claim 8, wherein said contacts are protectively positioned under said upper wall.

* * * * *